US006361342B1

(12) United States Patent
Cox

(10) Patent No.: US 6,361,342 B1
(45) Date of Patent: Mar. 26, 2002

(54) POTHEAD WITH PRESSURE ENERGIZED LIP SEALS

(75) Inventor: Don C. Cox, Roanoke, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/658,073

(22) Filed: Sep. 11, 2000

(51) Int. Cl.[7] ..... H01R 13/52
(52) U.S. Cl. ..... 439/275; 439/589; 277/615
(58) Field of Search ..... 439/275, 589, 439/272, 276; 277/615, 612, 620

(56) References Cited

U.S. PATENT DOCUMENTS

| | | | | |
|---|---|---|---|---|
| 3,583,710 A | | 6/1971 | Burelle | |
| 3,970,352 A | * | 7/1976 | Dorrell et al. | 439/595 |
| 4,353,560 A | * | 10/1982 | Tohill | 277/328 |
| 4,728,296 A | * | 3/1988 | Stamm | 439/275 |
| 4,859,200 A | | 8/1989 | McIntosh | |
| 5,205,568 A | | 4/1993 | Stoll | |
| 5,286,220 A | * | 2/1994 | Watson | 439/587 |
| 5,536,021 A | | 7/1996 | Boehmer | |
| 5,540,450 A | | 7/1996 | Hayashi | |
| 5,700,161 A | * | 12/1997 | Plummer et al. | 439/587 |
| 5,704,799 A | * | 1/1998 | Wood | 439/281 |
| 6,095,860 A | * | 8/2000 | Gehrke et al. | 439/587 |

* cited by examiner

*Primary Examiner*—Brian Sircus
*Assistant Examiner*—Hae Moon Hyeon
(74) *Attorney, Agent, or Firm*—Bracewell & Patterson, L.L.P.

(57) ABSTRACT

An electric submersible pump is provided having a pothead connector for use to connect a downhole cable to an electric motor of the submersible pump. The pothead connector has a housing having an upper and a lower end. The downhole cable has electrical conductors which are separately covered by insulation layers. The downhole cable extends through the upper end and into the housing, and then is electrically connected to the electric motor through the lower end of the housing. Two insulating blocks are provided in the lower end of the housing for separating electrical conductors in alignment for mating with a connector mounted to the electric motor. A conductor pin is secured to the insulating block and to each of the conductors. An elastic sealing ring is disposed within the housing, intermediately between the two insulating blocks. An epoxy layer are disposed within the upper end of the housing.

18 Claims, 3 Drawing Sheets

POTHEAD WITH PRESSURE ENERGIZED LIP SEALS

BACKGROUND OF THE INVENTION

The present invention relates in general to downhole electrical connectors for use in oil field applications, and in particular to a downhole pothead seal for connecting a motor lead to an electrical motor of a submersible pump assembly using pressure energized lip seals.

DESCRIPTION OF PRIOR ART

Electric submersible pumps have been used in oil wells to pump well fluids for many years. These types of prior art submersible pumps include electrical connectors for connecting the electric motors of the pumps to electrical conductors of downhole cables. These pumps are often used in corrosive environments such as wells that produce sour gas, and hydrogen sulfide ($H_2S$). Electrical connectors for electric submersible pumps typically have elastomeric seals or pothead connectors.

A problem encountered with pothead connections is the movement of conductors within the connector during installation and/or handling. This movement can cause shear stress damage to the cable insulation and the insulation within the connector itself, either of which is likely lead to the failure of the electrical connection.

As is particularly well known in the oil industry, the maintenance of power to such a pump is critical and at the same time made difficult by reasons of the extreme in pressures and temperatures and the character and nature of the well fluids to which the portion of the electric feedthrough system at the pump motor is subjected. That many problems have resulted from such circumstances has been frequently exhibited in the prior art apparatus applied for the same purpose. These problems have stemmed from many factors, not the least of which has been design characteristics of prior art apparatus which in many cases include the requirement for complete bonding of insulators and dielectrics thereof to one another and to the conductors which they peripherally encase as well as to the shell or housing by which they themselves are encased. Such a requirement is most difficult to satisfy. Where the bonding is not perfect, the pressure and temperature conditions within a well will make the electric feedthrough apparatus subject to infiltration by and seepage therein of well fluids with many undesirable results: short circuiting of the pump or motor, and electrical arcing or fire.

The improvements of the present invention substantially obviate many of the aforementioned problems. The inventor is not aware of any prior art which is specially pertinent to the improvements of the present invention as herein set forth and specifically claimed.

SUMMARY OF THE INVENTION

A pothead connector for use with an electric submersible pump is provided to connect a downhole cable to an electrical motor of the submersible pump. The pothead connector has a housing having a rearward or upper end and a forward or lower end. The downhole cable has electrical conductors that are separately covered by insulation layers. The downhole cable extends through the upper end and into the housing, and then is electrically connected to the electric motor through the lower end of the housing.

Two insulating blocks are provided in the lower end of the housing for separating and holding the electrical conductors in alignment and to prevent lateral movement of the conductors within the housing. A bore is provided through both the insulating blocks for each of the conductors. Each bore is provided with annular shoulders that face each other, one in the upper block and one in the lower block, for supporting and enclosing a seal that is located between the two blocks within the housing. The sealing ring has inner and outer lips some of which face the upper end of the housing, and the remainder of which face the lower end of the housing.

The inner lips of the seal provide a seal against the electrical conductors, and the outer lip of the seal provides a seal against the housing in the embodiment shown. The seal has a central web where all of the inner lips are connected to the outer lip. The seal also has openings for receiving each electrical conductor to feed them to a downhole pump motor.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
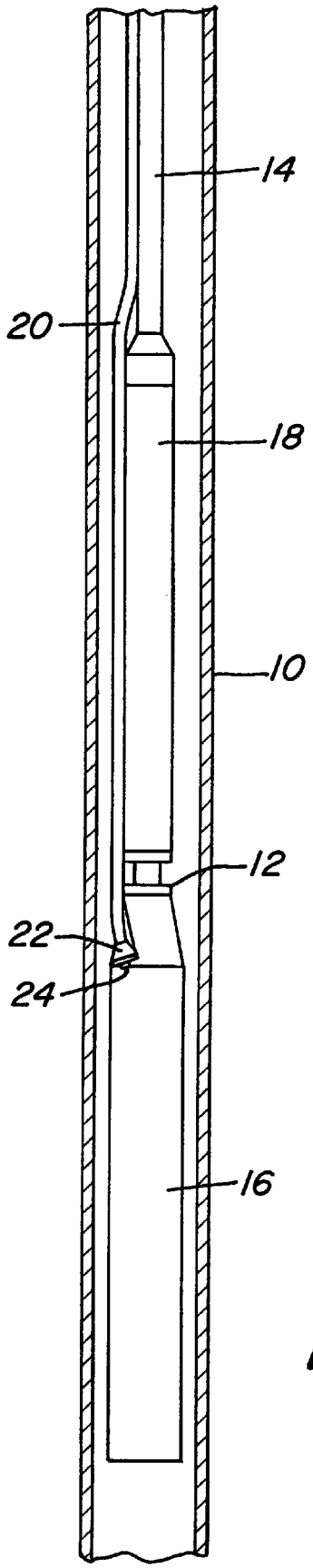
FIG. 1 is an elevational view of a well within which an electrical submersible pump is disposed.

FIG. 1 is an elevational section view of well 10 having electric submersible pump 12 disposed therein, mounted to tubing 14. Pump 12 includes an electric motor 16 and a pump section comprising centrifugal pump assembly 18. Cable 20 extends downhole, terminating in a motor lead to provide power to electric motor 16. Pothead connector 22 is mounted to the motor lead of cable 20, and electrically connects and secures the motor lead of cable 20 to housing 24 of motor 16.

Figure 2:
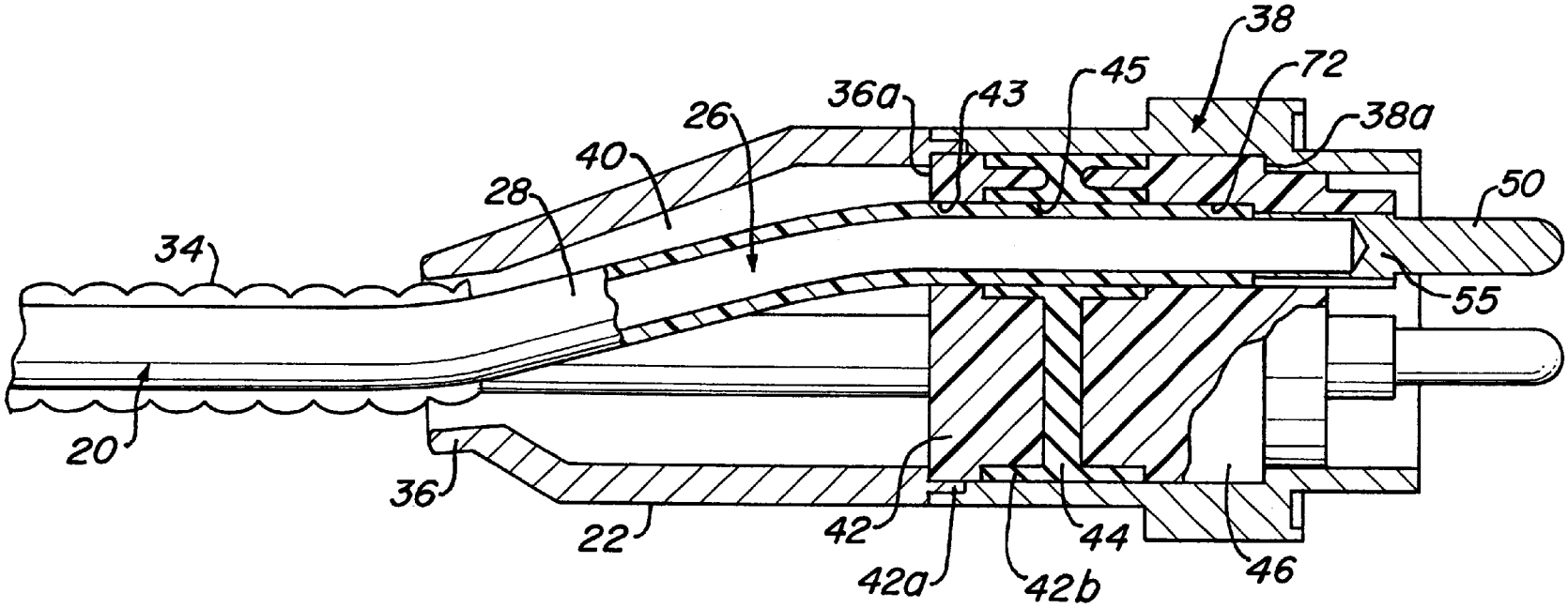
FIG. 2 is a longitudinal cross sectional view depicting the interior of the pothead connector made according to the present invention, mounted to the motor lead of the downhole electric cable.

Referring to FIG. 2, the motor lead of cable 20 is a flat cable containing three electrical conductors 26. Each conductor 26 is surrounded by one or more layers of conductor insulation 28 to protect and insulate the conductors from one another. Metal armor 34 encases and protects the elements of cable 20.

Connector 22 has a cap 36 that joins a cylindrical base 38, forming an outer housing. Cap 36 has a tapered interior end which extends around the exterior of armor 34 of cable 20. The interior of cap 36 is filled with epoxy 40, which acts as a retaining means to secure conductors 26 within cap 36 in alignment for extending into base 38 and provide strain relief for the cable. Epoxy 40 is a type of epoxy which is rated for high temperature service. The interior surface of cap 36 has a tapered profile, with the upper end periphery being smaller than the lower end periphery. After cap 36 is fastened to base 38 and layer of epoxy 40 is injected and cured, epoxy 40 will prevent movement of cap 36 and base 38 lower relative to armor 34 of cable 20.

As shown in FIG. 2, armor 34 has been stripped back from the terminal end of cable 20, so that armor 34 has a terminal end which is enclosed within the tapered portion of cap 36.

Figure 3:
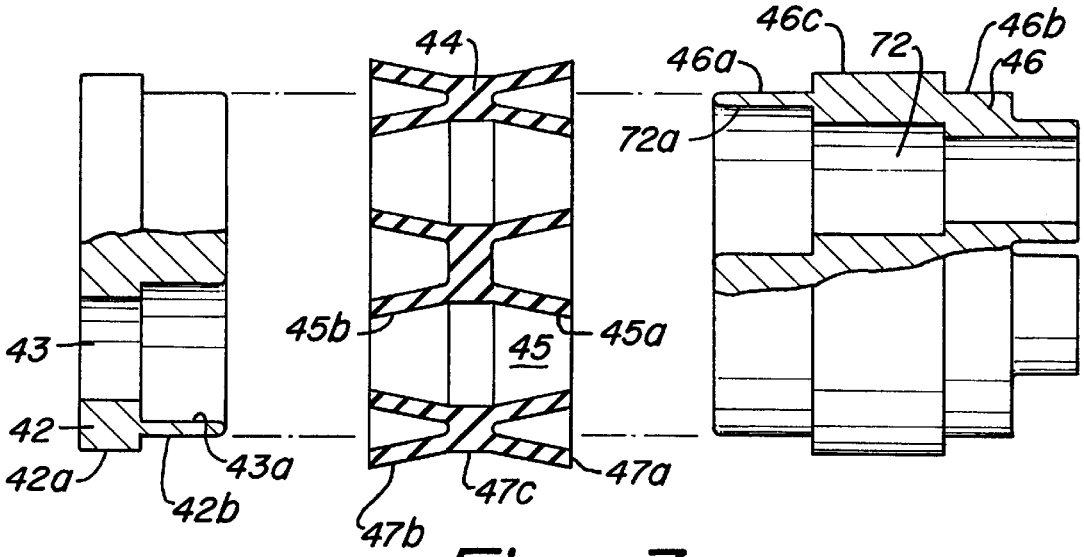
FIG. 3 is a partially exploded partially cross sectional view of the pothead connector of FIG. 2, with the sectional view of the seal being along line 3—3 of FIG. 4.
Figure 4:
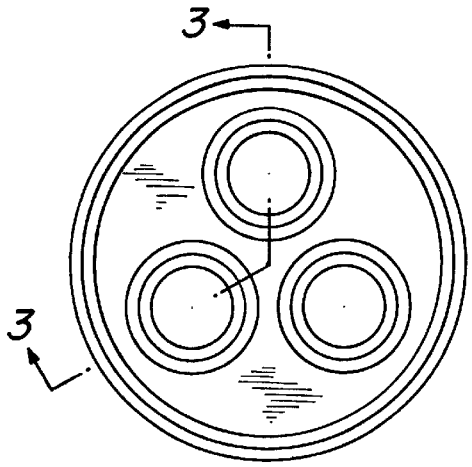
FIG. 4 is a front view of the seal of FIG. 3.
Figure 5:
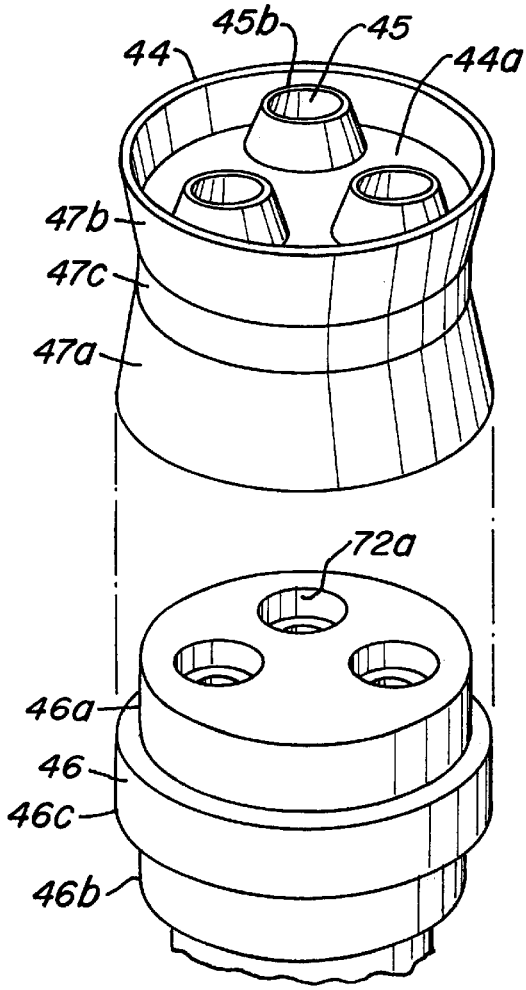
FIG. 5 is an isometric view of the seal and lower insulating block of FIG. 3.

An upper insulating block 42 is in base 38 near its upper end, with epoxy 40 being in contact with a upper side of insulating block 42. The upper insulating block 42 is provided with a plurality of bores 43 (three in preferred embodiment) therethrough for receiving insulated conductors 26 and aligning them with the electrical leads of a pump motor or other downhole device requiring electrical power or control. Conductor insulation 28 of each conductor 26 extends through one of the bores 43 of upper insulating block 42. As shown in FIG. 3, each bore 43 has a counterbore 43a that is greater in diameter than the upper end of the bore 43.

Upper insulating block 42 also has a cylindrical wall with an upper portion 42*a* and a lower portion 42*b* of slightly smaller diameter. The upper end of the upper insulating block 42 abuts a shoulder 36*a* in cap. The outer wall portion 42*a* fits closely in the inner diameter of cap 36 and a portion of base 38.

The materials that are used to form the upper insulating block 42 include various hard engineering grade plastics. The objective of the formulation for the upper insulating block 42 is to obtain a material that will exhibit strength, hardness, and insulating capabilities in the downhole environment. It is preferable that the material will be polyetheretherketone (PEEK).

A seal 44 is located on the forward or lower side of the upper insulating block 42. At least a portion of the exterior surfaces of insulation layers 28 into passages 45 of seal 44. The material for the seal 44 is selected so that it will seal directly but not adhere to the insulation layers 28, the upper insulating block 42, and the base 38. Each passage 45 also has an inner lower conical lip 45*a* cylindrical wall 47*c*. Outer conical lips 47*a*, 47*b* diverge outward from each other and when installed in base 38 are deformed to a cylindrical shape. Outer upper lip 47*b* seals the inner diameter of base 38. Seal web 44*a* provides continuity between the inner conical lips 45*a*, 45*b* and the outer conical lips 47*a*, 47*b*. The web 44*a* attaches to the inside the outer cylindrical wall 47*c* and to the outside of the inner conical lips 45*a*, 45*b* between the upper and lower seal. The web 44*a* prevents gas or liquid from penetrating the area between the inner and outer lip seals.

A second or lower insulating block 46 formed of a hard engineering grade plastic is mounted at the forward or lower end of base 38. The lower insulating block 46 is fixed within base 38 to prevent axial movement of the block within the housing. Insulating block 46 is provided with a plurality of bores 72 (three in preferred embodiment) therethrough for receiving insulated conductors 26 and aligning them with the electrical leads of a pump motor or other downhole device requiring electrical power or control. As shown in FIG. 3, each bore 72, has a counterbore 72*a* that is greater in diameter than the lower end of the bore 72.

Lower insulating block 46 also has a cylindrical wall with both an upper portion 46*a* and a lower portion 46*b* of slightly smaller diameter than the middle portion 46*c*. The lower end of the lower insulating block 46 abuts a shoulder 38*a* in the base 38. The outer wall portions 46*b*, 46*c* fit closely in the inner diameter of the base 38.

The materials that are used to form the lower insulating block 46 include various hard engineering grade plastics. The objective of the formulation for the lower insulating block 46 is to obtain a material that will exhibit strength, hardness, and insulating capabilities in the downhole environment. It is preferable that the material will be polyetheretherketone (PEEK).

The lower ends of electrical insulation layers 28 may be disposed within lower insulating block 46. At the lower end of base 38, insulation layers 28 are stripped from conductors 26 to provide a terminal end of cable 20. Connector pins 50 are soldered over the terminal ends of conductors 26. Connector pins 50 are provided for mating with electrical connectors in electric motor 16 of submersible pump 12 (shown in FIG. 1). Conductor pin 50 is preferably an elongated cylindrical member. The terminal end of conductor 26 is fixed in opening 55 of pin 50 by a solder weld. As described above, it is preferable that conductor insulation 28 on conductor 26 be stripped back so that conductor 26 may be inserted into and affixed with conductor pin 50. However, sufficient conductor insulation 28 should be left in place so that as cable 20 is inserted into lower insulating block bore 72, a portion of conductor insulation 28 is inserted into bore 72 along with conductor 26. Preferably, conductor insulation 28 will abut against upper end of conductor pin 50. Conductor pins 50 protrude from base 38.

Base 38, insulation 28, and seal 44 are to be selected of compatible corrosion resistant materials so that seal 44 will seal to the interior perimeter of base 38 and the exterior surface of conductor insulation 28. The material for seal 44 should also chosen so that the integrity of the seal is not lost due to contraction and/or expansion of the seal 44 under the extreme temperatures that may be encountered downhole.

With reference to FIG. 2, assembly of the pothead connector 22 onto cable 20 is now described. Cap 36 is first placed over the terminal end of cable 20 and pushed onto cable 20, away from the terminal end. Components of cable 20 are then stripped from the terminal end.

The first component of cable 20 which is stripped from the terminal end is metal armor 34. Armor 34 is stripped far enough from terminal end so that electrical connectors 26 may be separated within cap 36 and aligned for extending into base 38, for passing into the bores 43 of upper insulating block 42 and bores 72 of lower insulating block 46.

Conductor insulation 28 is preferably made of a material to which epoxy 40 will bond, such as E.P.D.M. Conductor insulation 28 is stripped from conductors 26 at a distance so that electrical conductors 26 will extend within lower insulating block 46. The terminal end of conductor insulation 28 will be within lower insulating block 46.

It is preferable that the elements shown in FIG. 3 be preassembled. Specifically, seal 44 should be inserted between upper insulating block 42 and lower insulating block 46. Conductors 26 should then be fed through the two blocks and seal combination, and installed in the base 38. The base 38 should be attached to the cap 36. Bolts (not shown) secure cap 36 to base 38. Conductor 26 should be soldered in place within opening 55 of conductor pin 50. Conductor pin 50 is then inserted into bore 72 of lower insulating block 46. Conductors 26 are prevented from lateral movement within the housing due to their immobilization in the lower insulating block 46. The upper outer cylindrical lip 47*b* seals and fits between the lower portion of the cylindrical wall 42*b* of the upper insulating block 42 and the inside diameter of the upper end of the base 38. The upper inner conical lips 45*b* seal and fit between the conductors 26 and the counterbores 43*a* in the upper insulating block 42. The lower outer cylindrical lip 47*a* seals and fits between the upper portion of the cylindrical wall 46*a* of the lower insulating block 46 and the inside diameter of the lower end of the base 38. The lower inner conical lips 45*a* seal and fit between the conductors 26 and the counterbores 72*a* in the lower insulating block 46. Liquid epoxy is then poured into cap 36 to provide epoxy layer 40 within cap 36. Epoxy layer 40 holds electrical conductors 26 in position within cap 36. Epoxy layer 40 will stabilize conductors 26 to prevent them from moving around and damaging seal 44.

Epoxy layer 40 is then cured by heating to 175 degrees Fahrenheit (80 deg. C.) for 1.5 hours, and then heating to 275 degrees Fahrenheit (135 deg. C.) for 45 minutes.

After pothead connector 22 is cooled, a sealing boot (not shown) is secured around a lower lip of base 38 and provides a seal between base 38 and the housing of electric motor 16 of pump 12. After being connected to motor 16, dielectric oil is pumped into motor 16. The oil migrates around pin 50 into bore 72, and up against seal 44. This eliminates void spaces that could later cause problems due to high pressure differential between the exterior of connector 22 and the internal spaces in connector 22. In use, the dielectric oil is maintained at a pressure equal to the external hydrostatic pressure by a pressure equalizer.

The present invention has several advantages over prior art electric submersible pumps having pothead connectors in hostile service applications. The base design allows filling of all voids with a dielectric fluid.

The seal 44 seals between the housing and the conductor insulation, encasing the electrical conductors, providing a seal which is impervious to liquid and gas leakage. The epoxy layer stabilizes the conductors so that they are fixed in place and physically contained to protect the electrical insulation against decompression damage.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

I claim:

1. A device for attaching an end of an electric cable to the head of a motor, the electric cable having at least one conductor, the device comprising in combination:

a housing;

an upper insulating block, contained within the housing, having at least one bore therethrough for receiving a conductor;

a lower insulating block, contained within the housing, having at least one bore therethrough for receiving the conductor, and wherein the bores of the upper insulating block and the lower insulating block share the same axis;

a seal assembly of an elastomeric material, contained within the housing between the blocks, having at least one passage sharing the same axis as the bores of the upper and lower insulating blocks, the seal assembly having at least one inner lip that while in an undeformed condition has an inner surface that tapers radially inward relative to the axis of the bores of the upper and lower insulating blocks for sealing around the conductor, the seal assembly having an outer periphery that seals against the housing.

2. The device of claim 1, wherein the outer periphery of the seal assembly comprises an outer lip encircling and sealing between an outer portion of one of the blocks and the housing, the outer lip, while in an undeformed condition, having an outer surface tapering radially outward relative to an axis of the housing.

3. The device of claim 1, wherein the inner surface of the inner lip is cylindrical when installed and sealing against the conductor.

4. The device of claim 1, wherein each of the bores of the upper and lower insulation blocks has a cylindrical counterbore of enlarged diameter and the inner lip extends into the counterbore of said one of the bores.

5. The device of claim 1, wherein said at least one inner lip comprises first and second inner lips facing in opposite directions, the first inner lip extending into the bore of the upper insulating block, the second one of the inner lips extending into the lower insulating block.

6. The device of claim 2, wherein the inner lip and the outer lip are joined by a central web.

7. The device of claim 1, wherein the outer periphery of the seal assembly comprises a first outer lip encircling and sealing between an outer portion of the upper insulating block and the housing and a second outer lip encircling and sealing between an outer portion of the lower insulating block and the housing, each of the first and second outer lips having an outer surface tapering radially outward while in an undeformed condition relative to an axis of the housing.

8. The device of claim 7, wherein said at least one inner lip comprises first and second inner lips, the first inner lip extending into the bore of the upper insulating block, the second inner lip extending into the bore of the lower insulating block, and said inner lips and said outer lips join at a central web.

9. In a power cable for supplying power to a downhole electric motor of a well pump, the power cable having a plurality of electrical insulated conductors, a connector for interconnecting each insulated conductor to an electrical connection of the motor, the connector comprising:

a housing;

an upper insulating block, contained within the housing, having a plurality of bores therethrough, each of the bores for receiving one of the conductors;

a lower insulating block, contained within the housing, having a plurality of bores therethrough, each of the bores of the lower insulating block for receiving one of the conductors, each of the bores of the upper insulating block aligning with one of the bores of the lower insulating block, the insulating blocks having cylindrical outer wall portions spaced radially inward from the housing;

an inner lip seal sealing around each of the conductors, having an inner upper lip that extends into one of the bores of the upper insulating block and an inner lower lip that extends into one of the bores of the lower insulating blocks, each of the inner upper and lower lips having an inner surface that tapers radially inward, while in an undeformed condition, relative to the an axis of the bore into which each of the inner upper and lower lips extend; and an outer lip seal having an outer upper lip that is between the cylindrical wall portion of the upper insulating block and the housing and an outer lower lip that is between the cylindrical wall portion of the lower insulating block and the housing, each of the outer upper and lower lips having an outer surface tapering radially outward, while in an undeformed condition, relative to an axis of the housing, and when installed sealing against the housing.

10. The connection of claim 9, wherein the inner surfaces of each of the inner upper and lower lips and the outer surface of each of the outer upper and lower lips are cylindrical when installed.

11. The connection of claim 9, wherein each of the insulation blocks has an enlarged outer diameter portion that is closely received by the housing.

12. The connection of claim 9, wherein said inner lip seals and said outer lip seals join at a central web.

13. The connection of claim 9, wherein the housing comprises a base portion that contains the upper and lower blocks and a cap portion, and wherein the cap portion of the housing is epoxy filled.

14. In a power cable for supplying power to a downhole electric motor of a well pump, the power cable having a plurality of electrical insulated conductors, a connector for interconnecting each insulated conductor to an electrical connection of the motor, the connector comprising:

a housing;

an upper insulating block, contained within the housing, having a plurality of bores therethrough, each of the bores for receiving one of the conductors;

a lower insulating block, contained within the housing, having a plurality of bores therethrough, each of the bores of the lower insulating block for receiving one of the conductors, each of the bores of the upper insulating block aligning with one of the bores of the lower insulating block, the insulating blocks having cylindrical outer wall portions spaced radially inward from the housing;

an inner lip seal sealing around each of the conductors, having an upper lip that extends into one of the bores of the upper insulating block and a lower lip that extends into one of the bores of the lower insulating blocks;

an outer lip seal having an upper lip that seals to the housing between the cylindrical wall portion of the upper insulating block and the housing and a lower lip seal that seals to the housing between the cylindrical wall portion of the lower insulating block and the housing; and wherein each of the bores has a counterbore of enlarged diameter and each of upper and lower lips of each of the inner lip seals extends into the counterbore of said one of the bores.

15. The connection of claim 14, wherein each of the counterbores of the upper and lower insulating blocks is cylindrical.

16. In a power cable for supplying power to a downhole electric motor of a well pump, the power cable having a plurality of electrical insulated conductors, a connector for interconnecting each insulated conductor to an electrical connection of the motor, the connector comprising:

a housing having a shoulder at the upper end and a shoulder at the lower end;

an upper insulating block, contained within and resting on the shoulder at the upper end of the housing and having an enlarged outer diameter portion that is closely received by the housing, the upper insulating block having a plurality of bores therethrough, each of the bores for receiving one of the conductors and having a counterbore of enlarged diameter;

a lower insulating block, contained within and resting on the shoulder at the lower end of the housing and having an enlarged outer diameter portion that is closely received by the housing, the lower insulating block having a plurality of bores therethrough, each of the bores of the lower insulating block for receiving one of the conductors and having a counterbore of enlarged diameter, each of the bores of the upper insulating block aligning with one of the bores of the lower insulating block;

an inner lip seal, conical in an undeformed condition and cylindrical when installed, sealing around each of the conductors, having an upper lip that extends into one of the counterbores of the upper insulating block and a lower lip that extends into one of the counterbores of the lower insulating block;

an outer lip seal, conical in an undeformed condition and cylindrical when installed, having an upper lip that seals to the housing between the cylindrical wall portion of the upper insulating block and the housing and a lower lip seal that seals to the housing between the cylindrical wall portion of the lower insulating block and the housing.

17. The connection of claim 16, wherein said inner lip seals and said outer lip seals join at a central web.

18. The connection of claim 16, wherein the housing comprises a base portion that contains the upper and lower blocks and a cap portion, and wherein the cap portion of the housing is epoxy filled.

* * * * *

UNITED STATES PATENT AND TRADEMARK OFFICE

CERTIFICATE OF CORRECTION

PATENT NO. : 6,361,342 B1
DATED : March 26, 2002
INVENTOR(S) : Don C. Cox

It is certified that error appears in the above-identified patent and that said Letters Patent is hereby corrected as shown below:

Column 3,
Line 3, delete “lower”
Line 8, delete “a” and insert therefor -- an --

Column 5,
Line 55, after “axis;” insert -- and --

Column 7,
Line 36, after “blocks;” insert -- and --

Column 8,
Line 32, after “block;” insert -- and --

Signed and Sealed this

Twenty-fifth Day of June, 2002

*Attest:*

*Attesting Officer*

JAMES E. ROGAN
*Director of the United States Patent and Trademark Office*